US006715838B1

(12) United States Patent
Pflaster et al.

(10) Patent No.: US 6,715,838 B1
(45) Date of Patent: Apr. 6, 2004

(54) CHAIR WITH SEAT SUPPORT BRACKETS

(75) Inventors: Zygmend Pflaster, Dallas, TX (US); Charles W. Davis, Oxnard, CA (US)

(73) Assignee: Zimports International, Inc., Dallas, TX (US)

( * ) Notice: Subject to any disclaimer, the term of this patent is extended or adjusted under 35 U.S.C. 154(b) by 0 days.

(21) Appl. No.: 10/279,333

(22) Filed: Oct. 24, 2002

(51) Int. Cl.[7] ..... A47C 7/02

(52) U.S. Cl. ..... 297/452.2; 297/239; 297/448.1; 297/452.19

(58) Field of Search ..... 297/445.1, 448.1, 297/452.2, 452.19, 452.18, 239

(56) References Cited

U.S. PATENT DOCUMENTS 1,911,224 A * 5/1933 Dellert
2,362,426 A * 11/1944 Wyatt
2,890,744 A * 6/1959 Ng
2,997,339 A 8/1961 Wilson
3,025,105 A * 3/1962 Nash
3,102,733 A 9/1963 Burnett
3,159,428 A * 12/1964 Schier
3,795,923 A 3/1974 Thomas
4,639,042 A 1/1987 Lange
5,564,787 A * 10/1996 Barile
5,626,394 A * 5/1997 Perry
5,762,396 A 6/1998 Barile
6,174,029 B1 1/2001 Swy

* cited by examiner

*Primary Examiner*—Milton Nelson, Jr.
(74) *Attorney, Agent, or Firm*—Gardere Wynne Sewell LLP

(57) ABSTRACT

A tubular frame convention or banquet chair, preferably of a stackable type, includes opposed support brackets which are secured to depending rear leg parts of the chair, extend upwardly at acute angles with respect to the rear leg parts and include distal flange parts for securing the support brackets to the underside of a seat member with mechanical fasteners. The support brackets are also welded to opposed longitudinal members of the frame.

16 Claims, 2 Drawing Sheets

CHAIR WITH SEAT SUPPORT BRACKETS

BACKGROUND OF THE INVENTION

Certain types of chairs, such as those used for conventions, banquets and similar events, must meet criteria including low weight, durability and stackability. These criteria are often in conflict with one another since durability and stackability, for example, often dictate a stronger chair than can be achieved with lightweight construction. Generally, a type of chair which is suitable for the aforementioned applications as well as other usage is characterized by a tubular seat frame and backrest frame suitably secured to opposed somewhat inverted U-shaped tubular legs. Of course, such chair construction also requires means for attaching the seat to the chair frame. In this regard, certain improvements have been sought in chairs of the general type described herein whereby material and manufacturing costs and weight are maintained at a reduced amount while strength and durability are maintained or enhanced and stackability is also provided for. It is to these ends that the present invention has been developed.

SUMMARY OF THE INVENTION

The present invention provides an improved chair of a type which includes a tubular frame and tubular legs, generally also of the type characterized as a so-called convention or banquet chair and which is also normally stackable.

In accordance with one aspect of the present invention, an improved chair is provided which includes a tubular perimeter seat frame and backrest frame, opposed legs, preferably formed as generally inverted U-shaped tubular members, and an improved arrangement of support brackets for supporting a seat member for connection to the chair frame and which support brackets provide improved strength and rigidity to the chair structure without significantly increasing chair weight.

Still further, the present invention provides an improved, so-called convention or banquet type chair which is stackable, which is characterized by two opposed support brackets secured to opposed legs of the chair, secured to the chair seat frame and secured to the seat to provide an improved rigid and durable chair structure.

Those skilled in the art will further appreciate the above-mentioned advantages and features of the invention as well as other important aspects thereof upon reading the detailed description which follows in conjunction with the drawing.

DETAILED DESCRIPTION OF PREFERRED EMBODIMENTS

Figure 1:
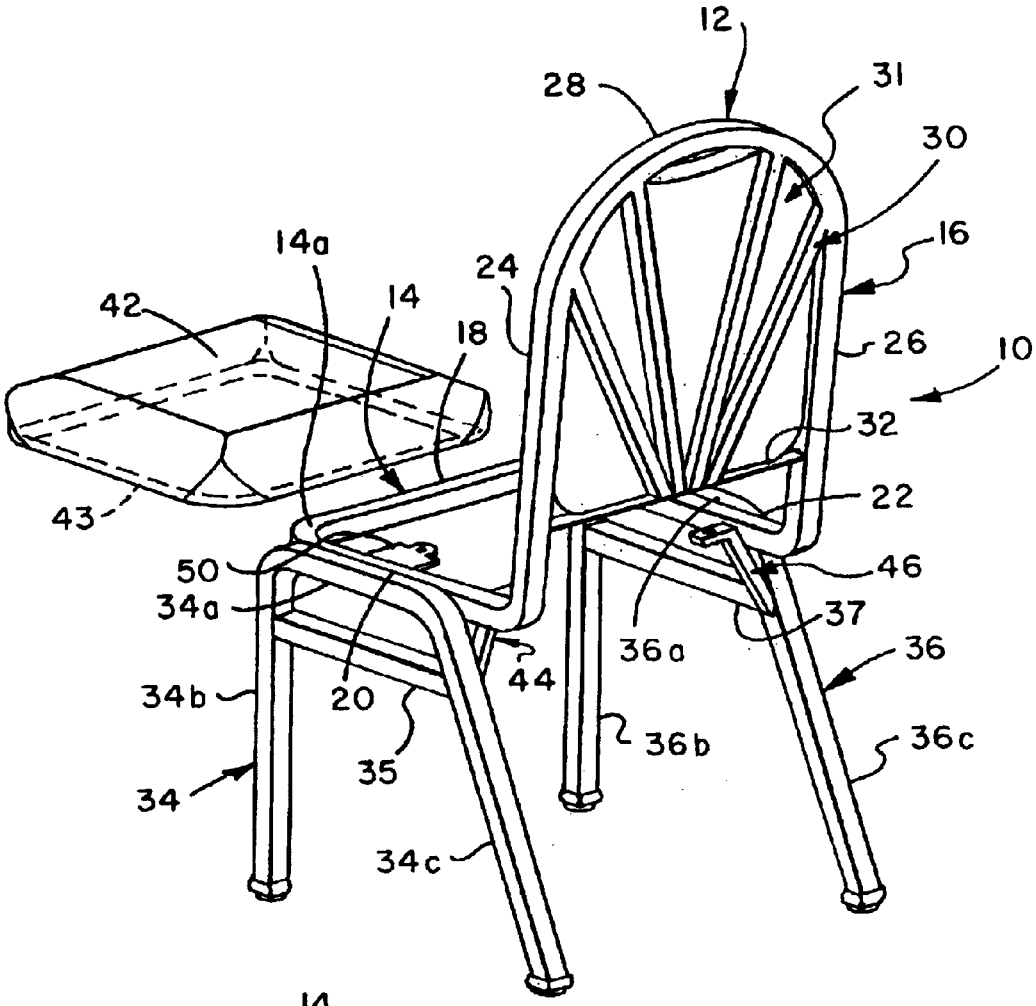
FIG. 1 is a perspective view of a chair in accordance with the present invention.

In the description which follows like parts are marked throughout the specification and drawing with the same reference numerals, respectively. The drawing figures are not necessarily to scale and certain features may be shown in somewhat generalized form in the interest of clarity and conciseness.

Referring to FIG. 1, there is illustrated a perspective view of a chair in accordance with the invention and generally designated by the numeral 10. The chair 10 is of a type typically used for convention seating, banquet seating and for other functions involving a relatively large number of persons. Typically, chairs of the type for which the invention is well suited are also stackable, as is the case with the chair 10. The chair 10 includes an integral frame member 12 comprising a seat frame part 14 and a backrest frame part 16. The integral seat and backrest frame 12 includes a transverse seat frame member 18 and opposed longitudinal side members 20 and 22 which are joined to opposed longitudinal backrest members 24 and 26. Longitudinal backrest members 24 and 26 are integrally joined to an arched backrest member 28. Ornamental, as well as functional, backrest part 30 extends between the backrest members 24, 26 and 28 and is also connected to a transverse backrest member 32. The chair 10 may or may not include a backrest cushion member 31, as shown, and suitably secured to the backrest frame 16.

The chair 10 further includes opposed, inverted, somewhat U-shaped tubular leg members 34 and 36 which may be of identical construction. Legs 34 and 36 include base parts 34*a* and 36*a*, respectively, together with integral depending front and rear leg parts 34*b* and 34*c* and 36*b* and 36*c*, respectively. The leg members 34 and 36 may be reinforced with transverse members 35 and 37, respectively. The seat frame part 14 is adapted to support a seat 42 which may include a somewhat rigid base member 43 formed of wood or plastic, for example, and shown as a generally planar part, by way of example. The member 43 may be of other configurations.

Figure 2:
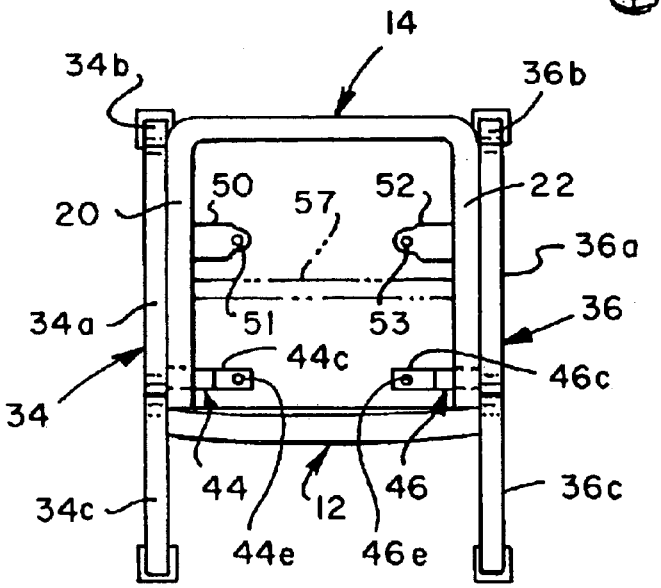
FIG. 2 is a top plan view of the chair shown in FIG. 1 with the seat removed.
Figure 3:
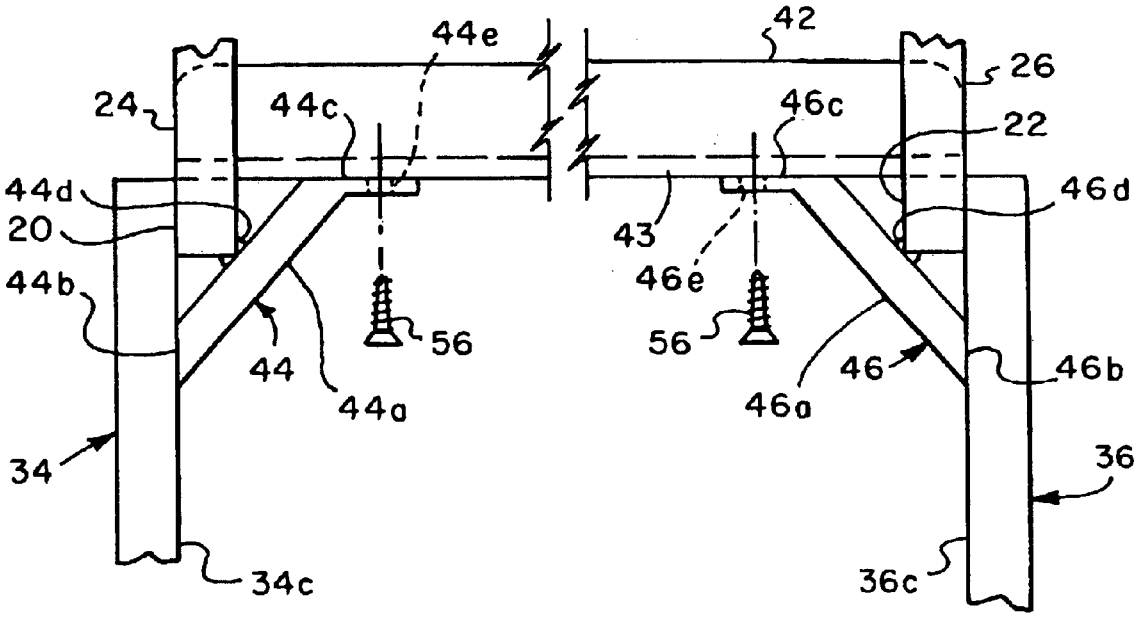
FIG. 3 is a rear elevation of the chair shown in FIG. 1 showing details of opposed seat support brackets.

Referring now to FIGS. 1 through 3, the chair 10 advantageously includes opposed seat support brackets 44 and 46 which are preferably formed as tubular or solid generally square cross section members having essentially the same (or slightly smaller) cross sectional dimensions as the square cross section tubular members which comprise the frame 12 and the leg members 34 and 36. Steel or aluminum rectangular or square cross section tubes or extruded plastic tubes may be used to form the frame 12 as well as the leg members 34 and 36. In a preferred embodiment, the frame 12 is formed from 0.75 inch square, eighteen gauge tubular steel, for example. The support brackets 44 and 46 include respective, solid or tubular square cross section beam portions 44*a* and 46*a* which, respectively, are secured to the rear leg parts 34*c* and 36*c* at welds 44*b* and 46*b*, FIG. 3.

Referring primarily to FIG. 3, the support brackets 44 and 46 preferably extend upwardly inclined at an angle of about forty-five degrees to thirty degrees with respect to vertical planes containing each of the legs 34 and 36, respectively. The support brackets 44 and 46 each include respective generally horizontally extending flanges 44*c* and 46*c* which are disposed at the distal ends of the respective brackets 44 and 46, as shown, and include respective fastener receiving openings 44*e* and 46*e* therein, FIG. 2. The flanges 44*c* and 46*c* extend substantially horizontally toward each other and are preferably coplanar with a planar support surface 14*a* of the seat frame part 14, FIG. 1, which surface is formed by the seat frame members 18, 20 and 22.

The support brackets 44 and 46 are also advantageously secured to the seat frame members 20 and 22, as shown in FIG. 3, at cooperating welds 44*d* and 46*d*. In this way, the leg members 34 and 36 are strengthened in their connection to the seat frame members 20 and 22 and the support brackets 44 and 46 are also strengthened and less susceptible to deflection and stress imposed on the fastening means comprising the welds 44*b* and 46*b*.

Figure 4:
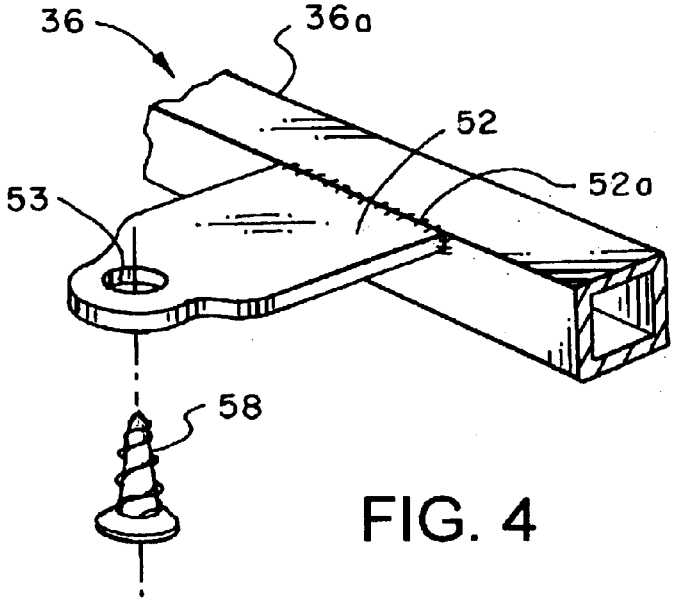
FIG. 4 is a detail perspective view of another seat support member for the chair of the present invention.

Still further, as shown in FIGS. 2 and 4, the chair 10 advantageously includes a second pair of opposed seat support brackets 50 and 52 which are suitably secured to the frame members 20 and 22, extend toward each other and are provided with fastener receiving holes 51 and 53. The brackets 50 and 52 may be secured to the members 20 and 22 by welding, as shown in FIG. 4. The brackets 50 and 52 are spaced from the brackets 44 and 46, as shown, and also include, respectively, upward facing surfaces which are substantially coplanar with the flanges 44*c* and 46*c* of the brackets 44 and. 46 to provide additional support structure for the seat 42. As shown in FIGS. 3 and 4, the brackets 44, 46, 50 and 52 are operable to receive suitable threaded fasteners 56 and 58, respectively, engageable with member 43 for securing the seat 42 to the chair frame 12.

Those skilled in the art will recognize the advantages of the support brackets 44, 46, 50 and 52. The brackets eliminate the requirement for support members which extend entirely across the span between the rear leg parts 34*c* and 36*c* and between the frame members 20 and 22. However, alternatively, in place of or in addition to the support brackets 50 and 52, a transverse beam frame member 57, FIG. 2, may extend between and be secured to the frame members 20 and 22 at its opposite ends by welding, for example. The member 57 may also include fastener receiving openings for securing a seat to the member 57.

The construction and use of the chair 10 is believed to be within the purview of one of ordinary skill in the art based on the foregoing description. Conventional engineering materials, including those mentioned hereinabove, may be used in constructing the chair 10. The frame 12 and leg members 34 and 36 may also be formed of cylindrical or oval cross section tubing or solid members of metal, wood or plastic. The leg members 34 and 36 may be secured to the frame members 20 and 22 at the base portions 34*a* and 36*a* by welding or by mechanical fasteners, as desired. The brackets 44, 46, 50 and 52 may, with minor modifications, also be secured to the chair legs and frame 12 by mechanical fasteners in place of or in addition to welding or the like, if desired.

Although a preferred embodiment of the invention has been described in detail herein, those skilled in the art will recognize that various substitutions and modifications may be made without departing from the scope and spirit of the appended claims.

What is claimed is:

1. A chair comprising:

a pair of opposed leg members, said leg members each including an elongated, depending leg part;

a frame joined to said leg members and forming a substantially horizontal seat support part;

a seat supported on said seat support part of said frame; and opposed support brackets connected, respectively, to respective ones of said leg parts and extending upwardly at an angle toward said seat, each of said support brackets including a portion for securing said support brackets to said seat, respectively.

2. The chair set forth in claim 1 wherein:

said support brackets are secured to opposed frame members of said seat support part of said frame, respectively.

3. The chair set forth in claim 2 wherein:

said support brackets are secured to said leg parts and to said frame members by welding, respectively.

4. The chair set forth in claim 2 wherein:

said leg members are disposed outboard of said frame members of said seat support part of said frame, respectively.

5. The chair set forth in claim 1 wherein:

said support brackets are secured to said seat by mechanical fasteners, respectively.

6. The chair set forth in claim 1 wherein:

at least portions of said leg members, said frame and said support brackets are formed of tubular members, respectively.

7. The chair set forth in claim 1 including:

opposed supports secured to said frame opposite each other and spaced from said support brackets, respectively.

8. The chair set forth in claim 1 including:

a beam extending between and secured to spaced apart members of said frame and spaced from said support brackets.

9. A stackable chair comprising:

a pair of spaced apart, substantially inverted U-shaped leg members, said leg members each providing a front leg part, a rear leg part and a substantially horizontally extending base part interconnecting said front and rear leg parts;

a frame disposed between said leg members and connected to respective ones of said leg members and forming a substantially horizontal seat support part;

a seat supported on said seat support part; and opposed first support brackets secured to said rear leg parts of said leg members, respectively, and extending upward toward each other at an acute angle with respect to said rear leg parts, respectively, each of said first support brackets including a distal bracket part provided with a fastener receiving opening therein for securing said first support brackets to said seat, respectively.

10. The chair set forth in claim 9 including:

opposed second support brackets secured to spaced apart frame members of said seat support part, respectively.

11. The chair set forth in claim 10 wherein:

said first support brackets are secured to said rear leg parts and to said frame members by welding, respectively.

12. A chair comprising:

spaced apart tubular substantially inverted U-shaped leg members each providing a front leg part, a rear leg part and a substantially horizontal base part extending between said front and rear leg parts;

a tubular seat frame disposed between and joined to said pair of leg members and having a substantially horizontal seat part joined to a substantially vertical backrest part;

a seat supported by said horizontal seat part of said frame; and spaced apart support brackets each secured, respectively, at one end to said rear leg parts and beneath a portion of said seat, said support brackets each extending at an acute angle with respect to said seat and including a flange portion thereon, respectively, for receiving fasteners for securing said support brackets to said seat, respectively.

13. The chair set forth in claim 12 wherein:

said support brackets are secured to said frame, respectively.

14. The chair set forth in claim 13 wherein:

said leg members and said support brackets are secured to said frame by welding.

15. The chair set forth in claim 12 including:

another pair of opposed support brackets secured to said frame and including fastener receiving openings therein, respectively, for receiving fasteners for securing said seat to said frame.

16. The chair set forth in claim 12 including:

a transverse beam extending between and secured to spaced apart frame members of said horizontal seat part of said seat frame.

* * * * *